US008680030B2

(12) United States Patent
Cartwright

(10) Patent No.: US 8,680,030 B2
(45) Date of Patent: Mar. 25, 2014

(54) ENHANCED DEPOSIT CONTROL FOR LUBRICATING OILS USED UNDER SUSTAINED HIGH LOAD CONDITIONS EMPLOYING GLYCERINE DERIVATIVE WITH A GRAFTED HINDERED PHENOLIC AND/OR A HINDERED PHENOLIC CONTAINING A THIOETHER GROUP

(75) Inventor: Stanley James Cartwright, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1361 days.

(21) Appl. No.: 11/590,547

(22) Filed: Oct. 31, 2006

(65) Prior Publication Data

US 2007/0117724 A1 May 24, 2007

Related U.S. Application Data

(60) Provisional application No. 60/738,323, filed on Nov. 18, 2005.

(51) Int. Cl.

| | |
|---|---|
| ***C10M 141/02*** | (2006.01) |
| ***C10M 141/08*** | (2006.01) |
| ***C10M 159/20*** | (2006.01) |
| ***C10M 159/22*** | (2006.01) |

(52) U.S. Cl.
USPC ..... 508/460; 508/391; 508/586; 508/584; 508/565

(58) Field of Classification Search
USPC ..... 508/391, 460, 586, 584, 565
See application file for complete search history.

(56) References Cited

U.S. PATENT DOCUMENTS

| | | | | |
|---|---|---|---|---|
| 4,846,983 | A | 7/1989 | Ward, Jr. | |
| 5,478,875 | A * | 12/1995 | Dubs et al. | 524/291 |
| 5,569,405 | A * | 10/1996 | Nakazato et al. | 508/192 |
| 5,837,657 | A | 11/1998 | Fang et al. | |
| 5,858,931 | A | 1/1999 | Tanaka et al. | |
| 6,140,282 | A | 10/2000 | Cartwright et al. | |
| 6,143,701 | A | 11/2000 | Boffa | |
| 6,159,911 | A | 12/2000 | Katafuchi | |
| 6,191,081 | B1 | 2/2001 | Cartwright et al. | |
| 6,300,291 | B1 | 10/2001 | Hartley et al. | |
| 6,855,675 | B1 | 2/2005 | Yamada et al. | |
| 2003/0148895 | A1 * | 8/2003 | Robson et al. | 508/155 |
| 2004/0110646 | A1 * | 6/2004 | Cartwright | 508/364 |
| 2004/0121918 | A1 | 6/2004 | Rea et al. | |
| 2005/0070447 | A1 | 3/2005 | Barnes et al. | |

FOREIGN PATENT DOCUMENTS

| | | | |
|---|---|---|---|
| EP | 0 562 172 | B1 | 9/1993 |
| EP | 0 761 804 | A1 | 3/1997 |
| EP | 1 046 698 | B1 | 10/2000 |
| EP | 1 195 426 | A1 | 4/2002 |
| EP | 1087001 | B1 | 5/2005 |
| EP | 1632553 | A1 | 3/2006 |

* cited by examiner

*Primary Examiner* — Jim Goloboy

(74) *Attorney, Agent, or Firm* — Robert A. Migliorini

(57) ABSTRACT

The present invention is directed to a lubricating oil for use in engines subjected to sustained severe load conditions, said lubricating oil comprising a base oil, and an additive package comprising one or more neutral/low TBN or a mixture of neutral/low TBN, and overbased/high TBN alkali or alkaline earth metal alkyl sulfonates, alkyl phenates, alkyl salicylates, an antioxidant selected from the group consisting of glycerine derivatives comprising glycerine grafted with a hindered phenol, hindered phenolic containing a thioether group, and mixtures thereof, optionally an additional conventional antioxidant and/or an organomolybdenum compound, and other additives, and to a method for enhancing the deposit formation resistance of a lubricating oil used in engines operated under sustained severe load comprising the addition to the lubricant of the aforesaid additive package.

10 Claims, No Drawings

ENHANCED DEPOSIT CONTROL FOR LUBRICATING OILS USED UNDER SUSTAINED HIGH LOAD CONDITIONS EMPLOYING GLYCERINE DERIVATIVE WITH A GRAFTED HINDERED PHENOLIC AND/OR A HINDERED PHENOLIC CONTAINING A THIOETHER GROUP

This application claims the benefit of U.S. Ser. No. 60/738,323 filed Nov. 18, 2005.

BACKGROUND OF THE INVENTION

The present invention is directed to lubricating oil formulation for use in engines operated under sustained high load conditions, such as stationary diesel engines, locomotive diesel engines, marine diesel engines, natural gas engines, etc., and to method for enhancing the deposit control capacity of the lubricating oils used in such sustained high load condition engines.

DESCRIPTION OF THE RELATED ART

It is known that internal combustion engines place enormous stresses on the lubricating oils. The oil is required to provide good lubrication under all conditions, provide protection against wear and corrosion, be stable to sustained levels of contamination, keep engine surfaces relatively clean, resist thermal and/or oxidative breakdown and carry away excess heat from the engine.

While all engines place such stresses on these lubricating oils, stationary diesels, and stationary natural gas engines are particularly challenging to the lubricating oil. For engines that routinely run continuously, near full load conditions, for many day or weeks, as in the case of stationary gas engines, and in remote locations, the demands placed on the oils used in such engines is of a sustained rather than transient nature, often with little or no monitoring and little or no opportunity to respond quickly to engine upsets or oil failure. This is further aggravated by the trend to higher loads and longer oil drain periods.

Typically, the oils used in such engines or environments use detergents, dispersants and antioxidants to achieve good oil life and wear control.

U.S. Pat. No. 6,140,282 teaches a long life lubricating oil composition comprising a major amount of a base oil of lubricating viscosity and a minor amount of a mixture of high TBN (>150), medium TBN (>50 to 150) and low/neutral TBN (10 to 50) detergents, wherein at least one of the medium a low/neutral TBN detergents is a metal salicylate. See also U.S. Pat. No. 6,191,081. Such lubricants are useful as gas engine oils.

U.S. Pat. No. 6,855,675 teaches an engine lubricating oil comprising a base oil of lubricating viscosity, a sulfoxy molybdenum dithiocarbamate having hydrocarbon groups containing 8 to 18 carbons in an amount sufficient to contribute from 200 to 1000 wt. ppm molybdenum to the total weight of the formulation, zinc dialkyldithiophosphate (ZDDP) selected from ZDDP's containing primary $C_1$-$C_{18}$ alkyl groups a mixture of ZDDP's containing primary $C_1$-$C_{18}$ alkyl groups and $C_3$-$C_{18}$ secondary alkyl group in an amount sufficient to provide 0.04 to 0.15 wt % phosphorus to the total weight of the composition, and a mixture of 50% to 100% by weight of a calcium alkylsalicylate and 50% to 0% by weight magnesium alkyl salicylate, the total amount of metal salicylate being from 1% to 10% by weight of the total composition.

EP 1 195 426 is directed to a natural gas engine oil having a TBN in the range of 2 to 20 and comprising a major amount of a base oil of lubricating viscosity, one or more hydrocarbyl substituted salicylate detergents having a TBN of 95 or less, one or more metal detergents, preferably salicylate, phenate or complex detergent having a TBN of greater than 250, one or more dispersants and one or more anti-wear additives. The dispersants are identified as preferably being ashless, as exemplified by succinimides; anti-wear additives may be metallic or non-metallic and include dihydrocarbyl dithiophosphate metal salts, the metal including alkaline earth metal, aluminum, lead, tin, molybdenum, manganese, nickel or copper zinc salts are preferred. Only zinc dialkyl dithiophosphates are exemplified.

U.S. Pat. No. 6,159,911 is directed to a lubricating oil for diesel engines in particular marine diesel engines and diesel engine power generation plants, especially medium-speed diesel engines, the oil comprising a base oil which may be mineral or synthetic, a detergent dispersant having a TBN of 100-600 mg KOH/g which is a per basic alkaline earth metal sulfonate, phenolate or salicylate and wherein the total phosphorous content of the composition is 100 wt. ppm or less and wherein the TBN of the formulated oil is 15-50 mg KOH/g. The engine oil may also contain an anti-wear agent used in an amount in the range of 0.1 to 3 wt % of the total composition and include organic molybdenum compounds such as molybdenum dithiophosphate, molybdenum dithiocarbamate, zinc dialkyl dithiophosphate, organic boron compounds such as alkyl mercaptyl borate, graphite, $MoS_2$. None of the examples contained any molybdenum compounds. The oils of U.S. Pat. No. 6,159,911 were found to exhibit enhanced resistance to oxidation and reduced wear.

EP 0 562 172 B1 is directed to an engine oil comprising a base oil which may be one or more mineral oils or synthetic oils or mixture thereof, a boron containing compound such as borated alkenylsuccinimide, an alkaline earth metal salt of salicylic acid, and an organomolybdenum complex such as molybdenum dithiophosphate or molybdenum dithiocarbamate in an amount sufficient to provide 100 to 2000 ppm molybdenum.

U.S. Pat. No. 6,143,701 is directed to a lubricating oil having improved fuel economy retention properties comprising a base oil and a combination of an overbased oil soluble calcium detergent and an oil soluble trinuclear friction modifying molybdenum compound. The trinuclear molybdenum compound is used in an amount sufficient to impart 50 to 750 ppm molybdenum to the finished oil. Calcium detergents include oil soluble overbased calcium sulfonates, phenates, sulfurized phenates, thiophosphonates, salicylates, naphthenates and carboxylates. Preferred overbased calcium detergents are the sulfonates with a TBN of 150 to 450 mg KOH/g and phenates or sulfurized phenates with a TBN of 50 to 450 mg KOH/g.

U.S. Pat. No. 6,300,291 is directed to a lubricating oil composition comprising a base oil, at least one calcium detergent, at least one oil soluble molybdenum compound, at least one nitrogen containing friction modifier and at least one zinc dialkyldithiophosphate compound. The molybdenum compound is present in an amount sufficient to provide up to about 350 ppm molybdenum. The calcium detergent is identified as neutral or overbased and derived from phenate, salicylates, sulfonates and mixtures thereof preferably sulfonates, said detergent having a TBN of at least 100, usually between 100 and 500.

U.S. Pat. No. 5,837,657 is directed to a method for improving the performance of sooted diesel oil, said method comprising adding to the diesel oil a particular trinuclear molybdenum compound.

U.S. Pat. No. 5,858,931 is directed to a lubricating oil composition comprising a base oil, at least one molybdenum compound selected from the group consisting of a particular sulfurized oxymolybdenum dithiocarbamate, a particular sulfurized oxymolybdenum dithiophosphate or a selected molybdenum amine compound and a (poly) glycerol ether and/or a (poly) oxyalkylene glycol monoalkyl ether. The lubricant is reported as exhibiting excellent stability to hydrolysis and excellent friction reduction even after deterioration in water.

There remains a need for a lubricant for use under sustained high load conditions exhibiting enhanced deposit control and for a method for enhancing the deposit control of oils used under sustained high load conditions.

SUMMARY OF THE INVENTION

The present invention is directed to an engine oil for use under sustained high load conditions comprising a major amount of a base oil of lubricating viscosity and a minor amount of an additive combination comprising one or more neutral/low TBN or a mixture of neutral/low TBN and overbased/high TBN alkali or alkaline earth metal salts of alkyl salicylate, sulfonate or phenate, a minor amount of a functionalized glycerine derivative with a grafted hindered phenolic and/or a hindered phenolic with a thioether group and, optionally, additional conventional antioxidants and/or an organomolybdenum complex.

Additional additives such as other detergents, e.g., neutral and/or overbased alkali or alkaline earth metal sulfonates, phenates, salicylates, complex/hybrid metal detergents and mixtures thereof may also be present, as well as ashless antioxidants, ashless dispersants, antiwear and extreme pressure additives, metal passivators, pour point depressants viscosity modifiers, viscosity index improvers, antifoamants, etc.

DETAILED DESCRIPTION OF THE INVENTION

It has been discovered that the deposit resistance and deposit control capacity of a lubricating oil used under sustained high load conditions such as stationary gas engine oil, stationary diesel engine oil, locomotive diesel engine oil, marine diesel engine oil, etc., can be dramatically improved by the addition to the oil used as the base oil for such engine lubricating oil of a mixture of additives comprising one or more neutral/low TBN or a mixture of neutral/low TBN and overbased/high TBN alkali or alkaline earth metal sulfonate, phenate or salicylate, preferably neutral/low TBN alkali and/or alkaline earth metal alkyl salicylates, and a functionalized glycerine derivative with a grafted hindered phenolic and/or a hindered phenolic with a thioether group and, optionally, an additional conventional antioxidant such as amine, aromatic amine, hindered aromatic amine, hindered phenol, and/or an organomolybdenum complex. As the antioxidant use is made of either or both of one or more functionalized glycerine derivative with a grafted hindered phenolic or one or more hindered phenol containing a thioether group.

The antioxidant employed is one or more of a functionalized glycerine derivative with a grafted hindered phenolic and/or a hindered phenolic with a thioether group.

These materials are present in an amount in the range of 0.1 to 3.0 vol %, preferably 0.25 to 2.0 vol %, most preferably 0.5 to 1.5 vol % active ingredient, based on the whole weight of the lubricating oil formulation.

The functionalized glycerine derivative with a grafted hindered phenolic is a liquid, phenolic partial ester. Main components are a glycerol backbone with one or more hindered phenolic moieties attached thereto through a reactive moiety at the ortho and/or para position of the aromatic ring of the hindered phenolic moiety such as a carboxylic acid group or alkali metal salt of a carboxylic acid group.

The hindered phenolic moiety bearing a reactive moiety at the ortho and/or para position of the aromatic ring through which it is bonded to a glycerine backbone may be represented for example by the general formula:

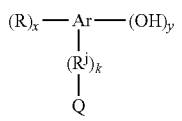

wherein R, x and Ar are as defined in great detail below, Q is the reactive moiety capable of reacting with the hydroxyl group(s) of the glycerine to yield the functionalized glycerine derivative with a grafted hindered phenolic, and $R^J$ is a $C_1$-$C_{10}$ alkylene group, preferably $C_1$-$C_5$ alkylene, more preferably $C_1$-$C_2$ alkylene, k is 0 or 1, and y is at least 1. Q can be a carboxylic acid group, or metal salt of a carboxylic acid group, an amide group, preferably a carboxylic acid group, metal salts of a carboxylic acid group, most preferably a carboxylic acid group.

The glycerine may be represented by the general formula:

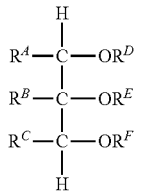

wherein $R^A$, $R^B$ and $R^C$ are the same or different and are selected from H, $C_1$-$C_{20}$ alkyl, $C_1$-$C_{20}$ alkenyl or sulfur substituted alkyl or alkenyl group, preferably $R^A$, $R^B$ and $R^C$ are H, and $R^D$, $R^E$ and $R^F$ are the same or different and are selected from H,

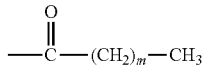

wherein m ranges from 0 to 20, preferably 1 to 10, and provided that 1 or 2 of $R^D$, $R^E$ and R are H.

For example, a functionalized glycerol

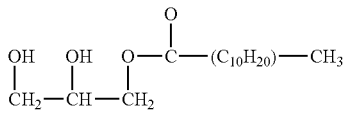

and isomers thereof can be reacted with

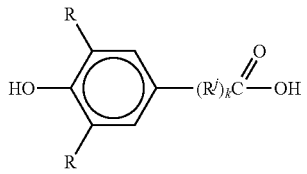

wherein $R^j$ is $C_1$-$C_{10}$ alkylene, preferably $C_2H_4$ and R is $C_1$-$C_{10}$ alkyl, preferably tert butyl, and k is 0 or 1, preferably 1 to give the glycerol derivative which is a mixture of the possible reaction products. An example of a useful glycerol derivative with a grafted phenolic moiety is Irgalube F10A.

The hindered phenolic containing a thioether group is a sulphur-bridged hindered phenolic antioxidant and can be described by the formula:

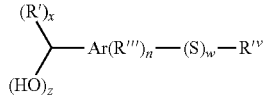

wherein Ar is as defined in great detail below, preferably Ar is

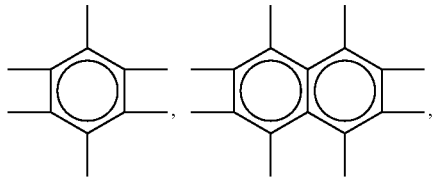

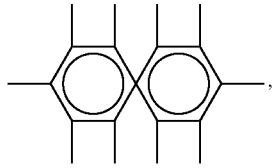

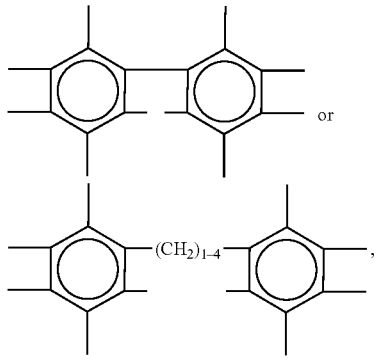

more preferably Ar is

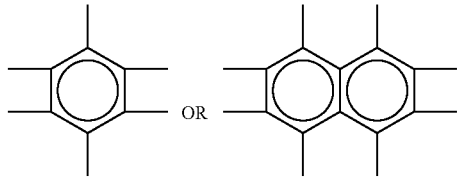

most preferably Ar is

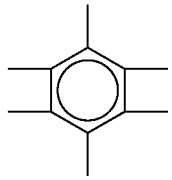

R' is selected from $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably a $C_3$-$C_{100}$ alkyl or sulfur substituted alkyl group, most preferably a $C_4$-$C_{50}$ alkyl group, z is at least 1, x ranges from one up to the available valance of the aromatic ring -(z), preferably x ranges from 1 to 3, most preferably x is 2, w ranges from 1 to 10, preferably 1 to 4, n ranges from 0 to 20, preferably 1 to 5, R''' is selected from $C_1$-$C_{20}$ alkyl, $C_2$-$C_{21}$ oxyether, $C_3$-$C_{21}$ ester, preferably $C_2$-$C_{10}$ alkyl, $C_2$-$C_{10}$ oxyether, $C_3$-$C_{11}$ ester, most preferably $C_2$-$C_5$ alkyl,

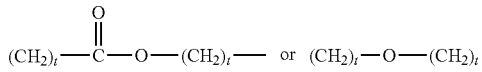

wherein the t's are the same or different, preferably the same, and each t range from 1 to 5, preferably 2-4, most preferably 2, $R^{IV}$ is selected from $C_3$-$C_{100}$ alkyl or alkenyl group or sulfur substituted alkyl or alkenyl group or a group of the formula

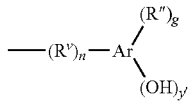

wherein Ar is as defined above, R'' is selected from the same group as R', and R' and R'' are the same or different, $R^v$ is selected from the same group as R''', and R''' and $R^V$ are the same or different, y' ranges from zero to 3, preferably y' is 1, and g ranges from zero up to the available valence of the aromatic -(y') and wherein g is at least 1 when y' is at least 1.

Preferably the phenolic containing a thioether group can be described by the formula:

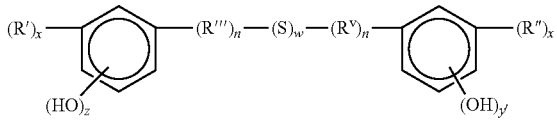

wherein R' and R" are the same or different and are selected from $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably or $C_4$-$C_{50}$ alkyl group, x ranges from one up to the available valance of the aromatic ring -(z), preferably x ranges from 1 to 3, most preferably x is 2, g ranges from zero up to the available valance of the aromatic ring -(y'), preferably g ranges from 1 to 3, most preferably g is 2, w ranges from 1 to 10, preferably 1 to 4, n ranges from 0 to 20, preferably 1 to 5, y' range from 0 to 3, preferably 1, z is at least 1, R'" and $R^v$ are the same or different and are selected from $C_1$-$C_{20}$ alkyl, $C_2$-$C_{20}$ oxyethers, $C_3$-$C_{21}$ esters, preferably $C_2$-$C_{10}$ alkyl, $C_2$-$C_{10}$ oxyethers, $C_3$-$C_{11}$ esters, more preferably R'" and $R^v$ are the same and are selected from $C_2$-$C_5$ alkyl,

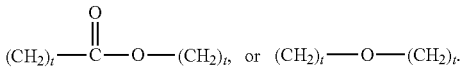

wherein t's are the same or different, preferably the same, and each t ranges from 1 to 5, preferably 2 to 4, most preferably 2. An example of a useful sulfur bridged hindered bisphenol is Irganox 1035, believed to be of the formula

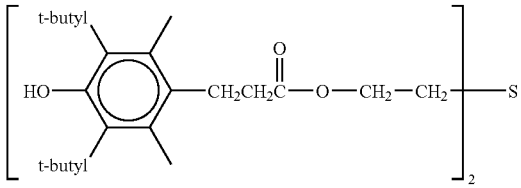

having a molecular weight of about 638 g/mole. The molecular weight of the phenolic containing a thioether group can range from at least about 238 g/mole preferably at least about 400 to 1200 g/mole, more preferably about 400 to 800 g/mole, most preferably about 638 to about 800 g/mole.

A necessary component of the present lubricating oil is one or more neutral/low TBN or mixture of neutral/low TBN and overbased/high TBN alkali or alkaline earth metal alkylsalicylate, sulfonate and/or phenate detergent preferably neutral/low TBN alkali or alkaline earth metal salicylate and at least one overbased/high TBN alkali or alkalene earth metal salicylate or phenate, and optionally one or more additional neutral and/or overbased alkali or alkaline earth metal alkyl sulfonate, alkyl phenolate or alkylsalicylate detergent, the detergent or detergent mixture being employed in the lubricating oil formulation in an amount sufficient to achieve a sulfated ash content for the finished lubricating oil formulation of about 0.1 mass % to about 2.0 mass %, preferably about 0.1 to 1.5 mass %, more preferably about 0.1 to about 1.0 mass %, most preferably about 0.1 to 0.7 mass %.

The TBN of the neutral/low TBN alkali or alkaline earth metal alkyl salicylate, alkyl phenate or alkyl sulfonate is about 150 or less mg KOH/g of detergent, preferably about 120 or less mg KOH/g, most preferably about 100 or less mg KOH/g while the TBN of the overbased/high TBN alkali or alkaline earth metal alkyl salicylate, alkyl phenate or alkyl sulfonate is about 160 or more mg KOH/g, preferably about 190 or more mg KOH/g, most preferably about 250 or more mg KOH/g, TBN being measured by ASTM D-2896.

The mixture of detergents is added to the lubricating oil formulation in an amount up to about 10 vol % based on active ingredient in the detergent mixture, preferably in an amount up to about 8 vol % based on active ingredient, more preferably up to about 6 vol % based on active ingredient in the detergent mixture, most preferably between about 1.5 to 5.0 vol %, based on active ingredient in the detergent mixture.

By active ingredient is meant the amount of additive actually constituting the name detergent or detergent mixture chemicals in the formulation as received from the additive supplier, less any diluent oil included in the material. Additives are typically supplied by the manufacturer dissolved, suspended in or mixed with diluent oil, usually a light oil, in order to provide the additive in the more convenient liquid form. The active ingredient in the mixture is the amount of actual desired chemical in the material less the diluent oil.

The lubricating oil base stock is any natural, synthetic, or unconventional lubricating base stock oil fraction typically having a kinematic viscosity at 100° C. of about 5 to 20 $mm^2/s$, more preferably about 5 to 16 $mm^2/s$, most preferably about 9 to 13 $mm^2/s$. In a preferred embodiment, the use of the viscosity index improver permits the omission of oil of viscosity about 20 $mm^2/s$ or more at 100° C. from the lube base oil fraction used to make the present formulation. Therefore, a preferred base oil is one which contains little, if any, heavy fraction, e.g., little, if any, lube oil fraction of viscosity 20 $mm^2/s$ or higher at 100° C.

A wide range of lubricating base oils is known in the art. Lubricating base oils that are useful in the present invention are natural oils, synthetic oils, and unconventional oils. Natural oil, synthetic oils, and unconventional oils and mixtures thereof can be used unrefined, refined, or rerefined (the latter is also known as reclaimed or reprocessed oil). Unrefined oils are those obtained directly from a natural, synthetic or unconventional source and used without further purification. These include for example shale oil obtained directly from retorting operations, petroleum oil obtained directly from primary distillation, and ester oil obtained directly from an esterification process. Refined oils are similar to the oils discussed for unrefined oils except refined oils are subjected to one or more purification or transformation steps to improve at least one lubricating oil property. One skilled in the art is familiar with many purification or transformation processes. These processes include, for example, solvent extraction, secondary distillation, acid extraction, base extraction, filtration, percolation, hydrogenation, hydrorefining, and hydrofinishing. Rerefined oils are obtained by processes analogous to refined oils, but use an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III basestock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table A summarizes properties of each of these five groups.

TABLE A

| Base Stock Properties | | | |
|---|---|---|---|
| | Saturates | Sulfur | Viscosity Index |
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stock is a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The PAOs which are known materials and generally available on a major commercial scale from suppliers such as ExxonMobil Chemical Company, Chevron, BP-Amoco, and others, typically vary in number average molecular weight from about 250 to about 3000, or higher, and PAOs may be made in viscosities up to about 100 $mm^2/s$ (100° C.), or higher. In addition, higher viscosity PAOs are commercially available, and may be made in viscosities up to about 3000 $mm^2/s$ (100° C.), or higher. The PAOs are typically comprised of relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of about 1.5 to 12 cSt.

Other useful synthetic lubricating base stock oils such as silicon-based oil or esters of phosphorus containing acids may also be utilized. For examples of other synthetic lubricating base stocks are the seminal work "Synthetic Lubricants", Gunderson and Hart, Reinhold Publ. Corp., New York 1962.

In alkylated aromatic stocks, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application No. 168 534 and U.S. Pat. No. 4,658,072. Alkylbenzenes are used as lubricant base-stocks, especially for low-temperature applications (arctic vehicle service and refrigeration oils) and in papermaking oils. They are commercially available from producers of linear alkylbenzenes (LABs) such as Vista Chem. Co, Huntsman Chemical Co., Chevron Chemical Co., and Nippon Oil Co. Linear alkylbenzenes typically have good low pour points and low temperature viscosities and VI values greater than about 100, together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

Non-conventional or unconventional base stocks/base oils include one or more of a mixture of base stock(s) derived from one or more Gas-to-Liquids (GTL) materials, as well as hydrodewaxed, or hydroisomerized/conventional cat (or solvent) dewaxed base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (isoparaffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched isoparaffins, are converted by cracking/fragmentation into lower molecular weight species to insure that the final oil product (base stock or base oil) has the desired product pour point;

f) "hydroisomerization" (or isomerization): a catalytic process in which normal paraffins (wax) and/or slightly branched iso-paraffins are converted by rearrangement/isomerization into branched or more branched isoparaffins (the isomerate from such a process possibly requiring a subsequent additional wax removal step to ensure that the final oil product (base stock or base oil) has the desired product pour point);

g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

h) "hydrodewaxing": (e.g., ISODEWAXING® of Chevron or MSDW™ of Exxon Mobil Corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

i) the terms "hydroisomerate", "isomerate", "catalytic dewaxate", and "hydrodewaxate" refer to the products produced by the respective processes, unless otherwise specifically indicated.

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term (or solvent), is included in the recitation, the process described involves hydroisomerization followed by solvent dewaxing which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from synthesized GTL materials such as for example, by distillation and subsequently subjected to a final wax processing step which is either the well-known catalytic dewaxing process, or solvent dewaxing process, to produce lube oils of reduced/low pour point; synthesized wax isomerates, comprising, for example, hydrodewaxed, or hydroisomerized/cat (or solvent) dewaxed synthesized hydrocarbons; hydrodewaxed, or hydroisomerized/cat (or solvent) dewaxed Fischer-Tropsch (F-T) material (i.e., hydrocarbons, waxy hydrocarbons, waxes and possible analogous oxygenates); preferably hydrodewaxed, or hydroisomerized/cat (or solvent) dewaxed F-T hydrocarbons, or hydrodewaxed or hydroisomerized/cat (or solvent) dewaxed, F-T waxes, hydrodewaxed, or hydroisomerized/cat (or solvent) dewaxed synthesized waxes, or mixtures thereof.

GTL base stock(s) derived from GTL materials, especially, hydrodewaxed, or hydroisomerized/cat (or solvent) dewaxed F-T material derived base stock(s), and other hydrodewaxed, or hydroisomerized/cat (or solvent) dewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater, but the GTL base stock and/or other hydrodewaxed, or hydroisomerized/cat (or solvent) dewaxed wax derived base stock(s) used in the present invention typically have kinematic viscosities in the range of about 5 $mm^2/s$ to 20 $mm^2/s$, preferably about 5 $mm^2/s$ to about 16 $mm^2/s$, more preferably about 9 $mm^2/s$ to 13 $mm^2/s$ at 100° C. Preferably the wax treatment process is hydrodewaxing carried out in a process using a single hydrodewaxing catalyst. Reference herein to Kinematic viscosity refers to a measurement made by ASTM method D445.

GTL base stocks and base oils derived from GTL materials, especially hydrodewaxed, or hydroisomerized/cat (or solvent) dewaxed F-T material derived base stock(s), and other hydrodewaxed, or hydroisomerized/cat (or solvent) dewaxed wax-derived base stock(s), which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. In the present invention, however, the GTL or other hydrodewaxed, or hydroisomerized/cat (or solvent) dewaxed wax-derived base stock(s)/base oils used are those having pour points of about −30° C. or higher, preferably about −25° C. or higher, more preferably about −20° C. or higher. References herein to pour point refer to measurement made by ASTM D97 and similar automated versions.

The GTL base stock(s) derived from GTL materials, especially hydrodewaxed or hydroisomerized/cat (or solvent) dewaxed F-T material derived base stock(s), and other such wax-derived base stock(s) which are base stock components which can be used in this invention are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydrodewaxed or hydroisomerized/cat (or solvent) dewaxed F-T material derived base stock(s), and wax-derived hydrodewaxed, or hydroisomerized/cat (or solvent) dewaxed base stock(s), such as wax isomerates or hydrodewaxates, are recited in U.S. Pat. Nos. 6,080,301; 6,090,989, and 6,165,949 for example.

Such base stock(s), derived from waxy feeds, which are also suitable for use in this invention, are paraffinic fluids of lubricating viscosity derived from hydrodewaxed, or hydroisomerized/cat (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

Slack wax is the wax recovered from any waxy hydrocarbon oil including synthetic oil such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock/base oil and/or wax isomerate base stock/base oil as used herein and in the claims is to be understood as embracing individual fractions of GTL base stock/base oil and/or of wax-derived hydrodewaxed or hydroisomerized/cat (or solvent) dewaxed base stock/base oil as recovered in the production process, mixtures of two or more GTL base stocks/base oil fractions and/or wax-derived hydrodewaxed, or hydroisomerized/cat (or solvent) dewaxed base stocks/base oil fractions, as well as mixtures of one or two or more low viscosity GTL base stock(s)/base oil fraction(s) and/or wax-derived hydrodewaxed, or hydroisomerized/cat (or solvent) dewaxed base stock(s)/base oil fraction(s) with one, two or more higher viscosity GTL base stock(s)/base oil fraction(s) and/or wax-derived hydrodewaxed, or hydroisomerized/cat (or solvent) dewaxed base stock(s)/base oil fraction(s) to produce a dumbbell blend wherein the blend exhibits a kinematic viscosity within the aforesaid recited range.

In a preferred embodiment, the GTL material, from which the GTL base stock(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) is/are derived is a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydrodewaxing, or hydroisomerizing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over the hydrodewaxing catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s), hydrodewaxed, or hydroisomerized/cat (or solvent) dewaxed wax-derived base stock(s), have a beneficial kinematic viscosity advantage over conventional API Group II and Group III base stocks, and so may be very advantageously used with the instant invention. Such GTL base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

In the present invention mixtures of hydrodewaxate, or hydroisomerate/cat (or solvent) dewaxate base stock(s), mixtures of the GTL base stock(s), or mixtures thereof, preferably mixtures of GTL base stock(s), can constitute all or part of the base oil.

One or more of these waxy feed derived base stocks and base oils, derived from GTL materials and/or other waxy feed materials can similarly be used as such or further in combination with other base stock and base oils of mineral oil origin, natural oils and/or with synthetic base oils.

The GTL base stock/base oil and/or hydrodewaxed and/or hydrioisomerized/cat (or solvent) dewaxed wax-derived base stock/base oil, preferably GTL base oils/base stocks obtained by the hydroisomerization of F-T wax, more preferably GTL base oils/base stocks obtained by the hydrodewaxing of F-T wax, can constitute from 5 to 100 wt %, preferably 40 to 100 wt %, more preferably 70 to 100 wt % by weight of the total of the base oil, the amount employed being left to the practitioner.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geq 4$), are such that: (a) $BI-0.5(CH_2 \geq 4)>15$; and (b) $BI+0.85\ (CH_2 \geq 4)<45$ as measured over said liquid hydrocarbon composition as a whole.

The preferred GTL base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geq 25.4$ and $(CH_2 \geq 4) \leq 22.5$. They have a nominal boiling point of 370° $C.^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);

b) divide the total carbon-13 integral area (chart divisions or area counts) by the average carbon number from step a. to obtain the integral area per carbon in the sample;

c) measure the area between 29.9 ppm and 29.6 ppm in the sample; and d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and polycarboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-methylphenyl) siloxanes.

Another class of synthetic lubricating oil is esters of phosphorous-containing acids. These include, for example, tricresyl phosphate, trioctyl phosphate, diethyl ester of decane-phosphonic acid.

Another class of oils includes polymeric tetrahydrofurans, their derivatives, and the like.

The lubricating oil containing the above described alkali and/or alkaline earth metal detergents and antioxidant can also, optionally, contain a conventional antioxidant.

Optional conventional anti-oxidants useful in the present invention may be of the phenol (e.g., o,o' ditertiary alkyl phenol such as ditertiarybutyl phenol), or amine (e.g., dialkyl diphenylamine such as dibutyl, octylbutyl or dioctyl diphenylamine) type, or mixtures thereof. These should be substantially non-volatile at peak engine operating temperatures. By substantially non-volatile is meant that there is less than 10% volatility at about 150° C., preferably at about 175° C., most preferably at about 200° C. and higher. The term "phenol type" used herein includes compounds having one or more than one hydroxy group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges or oxygen bridges. Alkyl phenols include mono- and polyalkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the "phenolic type" anti-oxidant may be represented by the general formula:

$$(R)_x—Ar—(OH)_y$$

where Ar is selected from the group consisting of:

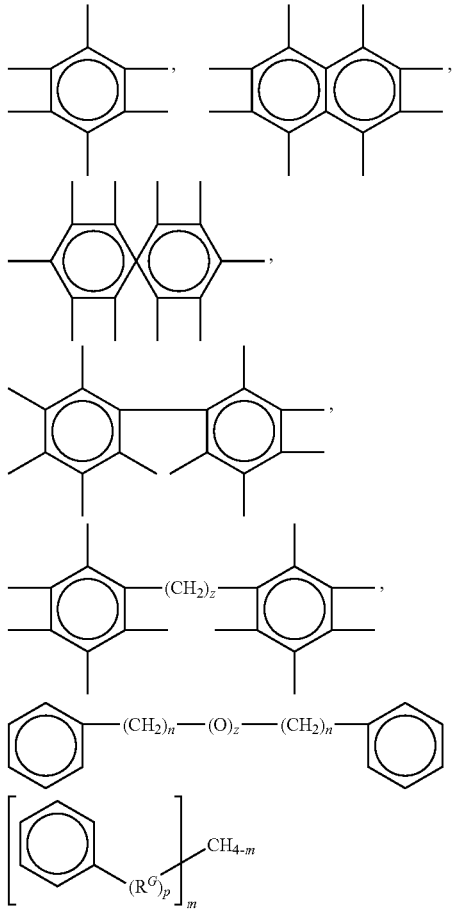

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Most preferably the phenol is a hindered phenol such as diisopropyl phenol, di-tert butyl phenol, di tert butyl alkylated phenol where the alkyl substitutent is hydrocarbyl and contains between 1 and 20 carbon atoms, such as 2,6 di-tert butyl-4 methyl phenol, 2,6-di-tert butyl-4-ethyl phenol, etc., or 2,6 di-tert butyl 4-alkoxy phenol.

Phenolic type anti-oxidants are well known in the lubricating industry and to those skilled in the art. The above is presented only by way of exemplification, not limitation on the type of phenolic anti-oxidants which can be used in the present invention.

The amine type antioxidants include diarylamines and thiodiaryl amines. Suitable diarylamines include diphenyl amine; phenyl-α-naphthylamine; phenyl-β-naphthylamine; α-α-di-naphthylamine; β-β-dinaphthylamine; or α-β-di-naphthylamine. Also suitable antioxidants are diarylamines wherein one or both of the aryl groups are alkylated, e.g., with linear or branched alkyl groups containing 1 to 12 carbon atoms, such as the diethyl diphenylamines; dioctyldiphenyl amines, methyl phenyl-α-naphthylamines; phenyl-β-(butyl-naphthyl) amine; di(4-methyl phenyl) amine or phenyl (3-propyl phenyl) amine octyl-butyl-diphenylamine, dioctyl-diphenyl amine, octyl-, nonyl-diphenyl amine, dinonyl di phenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α(methyl naphthyl) amine; thio-di (ethyl phenyl) amine; (butyl phenyl) thio phenyl amine.

Other suitable antioxidants include s-triazines of the formula

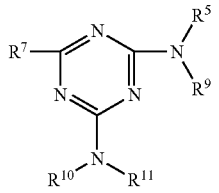

wherein $R^8$, $R^9$, $R^{10}$, $R^{11}$, are hydrogen, $C_1$ to $C_{20}$ hydrocarbyl or pyridyl, and $R^7$ is $C_1$ to $C_8$ hydrocarbyl, $C_1$ to $C_{20}$ hydrocarbylamine, pyridyl or pyridylamine. If desired, mixtures of antioxidants may be present in the lubricant composition of the invention.

The total amount of such conventional antioxidant or antioxidant mixtures used ranges from about 0.0 to 2.0 vol %, preferably about 0.05 to 2.0 vol %, more preferably about 0.1 to 1.75 vol %, most preferably about 0.5 to 1.5 vol % active ingredient.

As the optional organomolybdenum complex, use can be made of molybdenum dithiocarbamate, molybdenum dithiophosphate and molybdenum-nitrogen complexes, and if present at all is in the formulation in an amount sufficient to provide about 25 wt ppm to about 2000 wt ppm, preferably about 25 to about 500 wt ppm, most preferably about 25 to about 250 wt ppm.

As the molybdenum dithiocarbamate to be incorporated into the lubricant oil composition in accordance with the present invention, use may be made of a compound having the following formula:

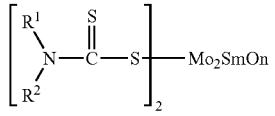

wherein $R^1$ and $R^2$, are independently a hydrocarbon group with 8 to 18 carbon atoms and may or may not be the same, m and n are a positive integer provided that M+n=4.

Examples of the hydrocarbon group having 8 to 18 carbon atoms, represented by $R^1$ and $R^2$ in the general formula include hydrocarbon groups such as an alkyl group having 8 to 18 carbon atoms, an alkenyl group having 8 to 18 carbon atoms, a cycloalkyl group having 8 to 18 carbon atoms, an aryl group having 8 to 18 carbon atoms, an alkylaryl group and an arylalkyl group. The above alkyl and alkenyl groups may be linear or branched. In the lubricating oil composition of the present invention, it is particularly preferable that the hydrocarbon group represented by $R^1$ and $R^2$ have 8 carbon atoms.

Specific examples of the hydrocarbon group represented by $R^1$ and $R^2$ include octyl, nonyl, decyl, undecyl, dodecyl, tridecyl, octenyl, noneyl, decenyl, undecenyl, dodecenyl, tridecenyl, tetradecenyl, hexadecenyl, octadecenyl, dimethylcyclohexyl, ethylcyclohexyl, methylcyclohexylmethyl, cyclohexylethyl, propylcyclohexyl, butylcyclohexyl, heptylcyclohexyl, dimethylphenyl, methylbenzyl, phenethyl, naphthyl and dimethylnaphthyl groups.

As the molybdenum dithiophosphate to be incorporated into the lubricating oil in accordance with the present invention, use may be made of a compound having the following formula:

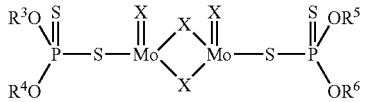

wherein $R^3$, $R^4$, $R^5$ and $R^6$ are the same or different hydrocarbyl group containing 8 to 18 carbons, X is oxygen or sulfur, preferably $R^3$-$R^6$ are $C_8$ to $C_{18}$ alkyl, alkenyl, cycloalkyl, aryl, alkylaryl, aralkyl, more preferably alkyl, most preferably $C_8$-$C_{10}$ alkyl.

The term "organomolybdenum-nitrogen complexes" as used in the text and appended claims to define certain molybdenum complexes useful in the present invention embrace the organomolybdenum-nitrogen complexes described in U.S. Pat. No. 4,889,647. The complexes are reaction products of a fatty oil, diethanolamine and a molybdenum source. Specific chemical structures have not been assigned to the complexes. U.S. Pat. No. 4,889,647 reports an infra-red spectrum for a typical reaction product of that invention; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organomolybdenum complexes which can be used in the present invention are tri-nuclear molybdenum-sulfur compounds described in EP 1 040 115 and the molybdenum complexes described in U.S. Pat. No. 4,978,464.

The formulation may also contain one or more of the commonly used additives. Thus, in addition to the recited detergents, the specific antioxidants and the optional conventional antioxidants and/or organo molybdenum complexes, the oil composition can contain one or more viscosity index improvers, pour point depressants, antiwear/extreme pressure additives, antifoamant, dyes, metal deactivators, additional detergents, dispersants, etc. Preferably, the additional commonly used additives are low ash or ashless. Further, to meet forthcoming more stringent formulated oil specifications any additional additives preferably should also be of low sulfur and low phosphorus content or if of conventional or high sulfur and/or phosphorus content used in low concentration such that the finished formulated lubricating oil has no more than about 1500 wppm P, preferably no more than about 1000 wppm P, more preferably no more than about 500 wppm P, most preferably no more than about 300 wppm P, and about 0.8 wt % or less S, preferably about 0.5 wt % or less S, most preferably about 0.2 wt % or less S.

Viscosity index improvers useful in the present invention include any of the polymers which impart enhanced viscosity properties to the finished oil and are generally hydrocarbon-based polymers having a molecular weight, Mw, in the range of between about 2,000 to 1,000,000, preferably about 50,000 to 200,000. Viscosity index improver polymers typically include olefin copolymers, e.g., ethylene-propylene copolymers, ethylene-(iso-) butylene copolymers, propylene-(iso-) butylene copolymers, ethylene-poly alpha olefin copolymers, polymethocrylates; styrene-diene block copolymers, e.g., styrene-isoprene copolymers, and star copolymers. Viscosity index improvers may be monofunctional or multifunctional, such as those bearing substitutents that provide a secondary lubricant performance feature such as dispersancy, pour point depression, etc.

Viscosity index improvers are lubricant additives well known in the lubricant industry and to those skilled in the art. The above is presented only by way of example and not as a limitation on the types of viscosity index improvers which can be used in the present invention.

The amount of viscosity index improver used, if any, be it mono functional or multifunctional, is typically in the amount of about 0.05 to 8 vol %, preferably about 0.1 to 4 vol %, most preferably about 0.3 to 2 vol % on an active ingredient basis.

The fully formulated lubricating oil may contain other additional, typical additives known to those skilled in the industry, used on an as-received basis.

Thus, the fully formulated oil may contain dispersants of the type generally represented by succinimides (e.g., polyisobutylene succinic acid/anhydride (PIBSA)-polyamine having a PIBSA molecular weight of about 700 to 2500). The dispersants may be borated or non-borated. The dispersant can be present in the amount of about 0.5 to 8 vol %, more preferably in the amount of about 1 to 6 vol %, most preferably in the amount of about 2 to 4 vol %.

Metal deactivators may be ofthe aryl thiazines, triazoles, or alkyl substituted dimercapto thiadiazoles (DMTD's), or mixtures thereof. Metal deactivators can be present in the amount of about 0.01 to 0.2 vol %, more preferably in the amount of about 0.02 to 0.15 vol %, most preferably in the amount of about 0.05 to 0.1 vol %.

Antiwear additives such as metal dithiophosphates (e.g., zinc dialkyl dithiophosphate, ZDDP), metal dithiocarbamates, metal xanthates or tricresylphosphates may be included. Antiwear additives can be present in the amount of about 0.05 to 1.5 vol %, more preferably in the amount of about 0.1 to 1.0 vol %, most preferably in the amount of about 0.2 to 0.5 vol %.

Pour point depressants such as poly(meth)acrylates, or alkylaromatic polymers may be included. Pour point depressants can be present in the amount of about 0.05 to 0.6 vol %, more preferably in the amount of about 0.1 to 0.4 vol %, most preferably in the amount of about 0.2 to 0.3 vol %.

Antifoamants such as silicone antifoaming agents can be present in the amount of about 0.001 to 0.2 vol %, more preferably in the amount of about 0.005 to 0.15 vol %, most preferably in the amount of about 0.01 to 0.1 vol %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, page 1-11.

The present invention is illustrated further in the following non-limiting examples and comparative examples.

EXPERIMENTAL

An in-house proprietary deposit screener test was employed to measure the deposit tendency of crankcase oils. This test was developed to reasonably mimic the engine conditions likely to cause deposits on valves and in the piston-ring zone; commercial oils of well-established good and poor deposit control in severe field conditions were used in developing the test. The final conditions chosen and test methodology achieved excellent oil performance discrimination and repeatability for these commercial reference oils. The screener test measures the weight of lubricant-derived deposits that accumulate on a weighed metal coupon, under conditions of elevated temperature, test length and metal surface-oil contact. For relatively low deposit weights, particular attention is also paid to test coupon appearance, i.e., the % of the panel surface covered by deposit (varnish and/or black carbon) is simply quantified by visual examination.

Low ash gas engine oils (0.3-0.6 mass % sulphated ash) being the single largest segment of the medium and high speed stationary gas engine oil market worldwide, was evaluated in the deposit screener test, encompassing mineral oil basestock systems, as reported in Tables 1, 2 and 3. The reference and comparative oils 1 and 2 represent the current commercial technology oils with known field performance. Reference oil 1, Comparative Oils 1 and 2, as well as the oils of the present invention, are all low ash gas engine oils, containing API Group II basestock systems. Reference Oil 1 has been observed to cause unsatisfactorily high deposit levels in the field, while Comparative Oils 1 and 2 have shown at least satisfactory deposit control in the field. The screener test results showed heavy deposit accumulation (47.6 mg) for Reference Oil 1, with about 90% of the panel surface covered by black, carbonaceous deposits; somewhat less deposit weight for Comparative Oils 1 and 2 (20.3 and 21.0 mg, respectively) was accompanied by about 50% and 65% respectively of panel surfaces covered by deposits. The second result of 23.2 mg weight for Comparative Oil 1 illustrates the good repeatability of this test. Clearly, the test provides good quantitative and visual discrimination between oils of known good and poor field performance.

EXAMPLES

The Invention examples of Tables 1, 2 and 3 and Comparative oils 3-6 are all low ash formulations that rely on various combinations of metal detergents, ashless dispersants (borated and non-borated), ZDDP, ashless antioxidant, metal passivator, viscosity index improver, pour point depressant and antifoamant. In addition, Invention examples 1-3 apply novel, ashless antioxidant combinations: (1) a functionalized glycerine derivative with a grafted hindered phenolic moiety, (2) a hindered phenolic containing a thioether group, in this case a thioether bis hindered phenol, and (3) a conventional hindered phenolic. Examples 1-3 all show measurably reduced deposit formation, ranging from 12.8 to 18.3 mg deposit weight and about 50% clean panel surface in all three cases. The use of the functionalized glycerine derivative as the sole antioxidant (Example 1), or combined with the other two phenolic antioxidants (Example 3), particularly reduced deposit weight.

Invention examples 4 to 10 additionally contain an oil-soluble, organometallic molybdenum dithiocarbamate, at treat rates that provided from about 25 wt ppm to about 50 wt ppm of elemental molybdenum to the final oil composition. Each of these seven invention example formulations of Tables 1 and 2 further reduced deposit weights to as low as 4.6 mg and yielded up to 80% clean panel surface.

The component formulations in Table 3 explore further the boundaries of this invention. The invention examples 11 to 14 demonstrate that single low TBN detergents can be used with the hindered phenolic containing a thioether group and provide excellent deposit control, with or without a molybdenum source. These results show also that low TBN salicylate is more effective than low TBN phenate for the same amount of calcium contributed to the finished oil. Comparison of examples 2 and 15 shows that it is not necessary to include conventional phenolic antioxidant with the hindered phenolic containing a thioether group in order to measurably reduce deposit formation, even in the absence of molybdenum. Comparison of examples 6 and 16 shows that 25 wppm molybdenum did not further improve deposit control in the presence of the glycerine derivative; the detergent system-glycerine derivative combination achieved very effective deposit reduction Several of the invention examples demonstrate that soluble molybdenum from dithiocarbamate can enhance the already excellent deposit control of the examples' detergent—hindered phenolic containing a thioether group and detergent—functionalized glycerine derivative with a grafted hindered phenol combinations. Comparative oils 3 to 6 show that restricting the detergent system to overbased salicylate and/or phenate causes a large deterioration in deposit control, relative to the reference oil. This is despite the presence of the hindered phenolic containing a thioether group in amounts that have been shown to be effective in other examples above. Inclusion of 50 ppm of soluble molybdenum in these high deposit formulations did result in a lowering of deposit weight, but the deposit weights were still as bad as or worse than that of the reference oil.

TABLE 1

| Component (vol %) | Description | Reference Oil 1 | Comparative Oil 1 | Comparative Oil 2 | Invention Example 1 | Invention Example 2 | Invention Example 3 | Invention Example 4 | Invention Example 5 |
|---|---|---|---|---|---|---|---|---|---|
| | Commercial sample | 100.00 | — | — | — | — | — | — | — |
| | Commercial sample | — | 100.00 | — | — | — | — | — | — |
| | API Group II Basestock | — | — | 89.50 | 88.0 | 90.25 | 89.75 | 89.66 | 91.66 |
| | Low TBN calcium alkylsalicylate TBN~64 | — | — | 4.00 | 4.00 | 4.00 | 4.00 | 4.00 | 4.00 |
| | Overbased calcium phenate TBN~250 | — | — | 0.50 | 0.50 | 0.50 | 0.50 | 0.50 | 0.50 |
| | Phenolic antioxidant (conventional) | — | — | 1.50 | — | 0.75 | 0.75 | 0.75 | 0.75 |
| | Glycerine derivative (Irgalube F10A) | — | — | — | 1.50 | — | 0.50 | 0.50 | — |
| | Molybdenum dithiocarbamate | — | — | — | — | — | — | 0.09 | 0.09 |
| | Balance of additive system | — | — | 4.50 | 6.00 | 4.50 | 4.50 | 4.50 | 3.00 |
| | Hindered thio-ether phenolic Irganox 1035 | — | — | — | — | 0.75 mass % | 0.50 mass % | 0.50 mass % | 0.75 mass % |
| Viscosity | measured kV @ 100° C. | 13.2 | 13.19 | ~13 | ~13 | ~13 | ~13 | ~13 | ~13 |
| Molybdenum content | Wt ppm | 0 | 0 | 0 | 0 | 0 | 0 | 50 | 50 |
| Deposit Screener Test | Deposit Weight, mg | 47.6 | 20.3, 23.2 | 21.0 | 14.1 | 18.3 | 12.8 | 4.6 | 8.5 |
| Panel Surface Deposit Coverage (%) | | 90 | ~50 | ~65 | ~50 | ~50 | ~50 | ~20 | ~30 |

TABLE 2

| Component (vol %) | Description | Reference Oil 1 | Invention Example 6 | Invention Example 7 | Invention Example 8 | Invention Example 9 | Invention Example 10 |
|---|---|---|---|---|---|---|---|
| | Commercial sample | 100.00 | — | — | — | — | — |
| | API Group II Basestock | — | 64.205 | 64.16 | 66.16 | 89.27 | 89.13 |
| | API Group II Basestock | — | 25.00 | 25.00 | 25.00 | — | — |
| | API Group II Basestock | — | — | — | — | 1.64 | 2.78 |
| | Low TBN calcium alkylsalicylate TBN~64 | — | 4.00 | 4.00 | 2.00 | 3.00 | — |
| | Neutral calcium sulphonate TBN~26 | — | — | — | — | — | 0.50 |
| | Low TBN calcium phenate TBN~114 | — | — | — | 1.00 | 0.50 | 2.20 |
| | Overbased calcium phenate TBN~250 | — | 0.50 | 0.50 | 0.50 | 0.50 | 0.30 |
| | Phenolic antioxidant (conventional) | — | 1.00 | 1.00 | — | 1.00 | 1.00 |
| | Glycerine derivative (Irgalube FIOA) | — | 0.75 | 0.75 | 0.75 | — | — |
| | Molybdenum dithiocarbamate | — | 0.045 | 0.09 | 0.09 | 0.09 | 0.09 |
| | Balance of additive system | — | 4.50 | 4.50 | 4.50 | 4.00 | 4.00 |
| | Hindered thio-ether phenolic (Irganox 1035) | — | — | — | 0.75 mass % | 0.75 mass % | 0.75 mass % |
| Viscosity | measured kV @ 100° C. | 13.2 | ~13 | ~13 | ~13 | ~13 | ~13 |
| Molybdenum content | Wt ppm | 0 | 25 | 50 | 50 | 50 | 50 |
| Deposit Screener Test | Deposit Weight, mg | 47.6 | 8.0 | 8.2 | 6.0 | 7.9 | 7.2 |
| Panel Surface Deposit Coverage (%) | | ~90 | ~30 | ~35 | ~20 | ~30 | ~35 |

TABLE 3

| Component (vol %) | Description | Invention Example 11 | Invention Example 12 | Invention Example 13 | Invention Example 14 | Invention Example 15 | Invention Example 16 | Comparative Oil 3 | Comparative Oil 4 | Comparative Oil 5 | Comparative Oil 6 |
|---|---|---|---|---|---|---|---|---|---|---|---|
| | API Group II Basestock | 88.30 | 88.21 | 91.50 | 91.41 | 91.10 | 89.25 | 93.662 | 93.572 | 93.25 | 93.16 |
| | Low TBN calcium alkylsalicylate TBN~64 | 6.30 | 6.30 | — | — | 4.00 | 4.00 | — | — | — | — |
| | Low TBN calcium phenate TBN~114 | — | — | 3.10 | 3.10 | — | — | — | — | — | — |
| | Overbased calcium phenate TBN~250 | — | — | — | — | 0.50 | 0.50 | — | — | 1.35 | 1.35 |
| | Overbased calcium salicylate TBN~350 | — | — | — | — | — | — | 0.938 | 0.938 | — | — |
| | Phenolic antioxidant | 1.00 | 1.00 | 1.00 | 1.00 | — | 1.00 | 1.00 | 1.00 | 1.00 | 1.00 |
| | Glycerine derivative (Irgalube FIOA) | — | — | — | — | — | 0.75 | — | — | — | — |
| | Molybdenum dithiocarbamate | — | 0.09 | — | 0.09 | — | — | — | 0.09 | — | 0.09 |
| | Balance of additive system | 4.40 | 4.40 | 4.40 | 4.40 | 4.40 | 4.50 | 4.40 | 4.40 | 4.40 | 4.40 |
| | Hindered thio-ether phenolic (Irganox 1035) | 0.75 mass % | 0.75 mass % | 0.75 mass % | 0.75 mass % | 0.75 mass % | — | 0.75 mass % | 0.75 mass % | 0.75 mass % | 0.75 mass % |
| Viscosity | measured kV @ 100° C. | 13.2 | ~13 | ~13 | ~13 | ~13 | ~13 | ~13 | ~13 | ~13 | ~13 |
| Molybdenum content | Wt ppm | 0 | 50 | 0 | 50 | 0 | 0 | 0 | 50 | 0 | 50 |
| Deposit Screener Test | Deposit Weight, mg | 4.2 | 7.3 | 12.2 | 6.5 | 19.3 | 8.5 | 121.2 | 70.4 | 112.5 | 48.2 |
| Panel Surface Deposit Coverage (%) | | ~15 | ~10 | ~25 | ~15 | ~60 | ~40 | 100 | 100 | 100 | 100 |

Invention examples 1-16 provide exceptional deposit control, beyond that of the current commercial technology and beyond what could be expected for the ash level; i.e., the metallic detergent treat. The novel combinations of functionalized glycerine derivative with a grafted hindered phenolic and/or hindered phenolic containing thioether with or without additional conventional hindered phenolic provided substantial deposit control, which would not be expected under such conditions of service for an already premium oil formulation. The inclusion of an organometallic molybdenum dithiocarbamate at a very low level (Examples 4-10, 12 and 14) unexpectedly enhanced the already very good deposit control typical of Invention examples 1-3 and 13. Organometallic molybdenum complexes are known for their ability to provide improved friction, EP/antiwear performance and sometimes oxidation control, but the very low treat of molybdenum complex combined with the unique antioxidant combinations in the invention examples resulted in very low deposit accumulation and dramatically cleaner panel surfaces.

What is claimed is:

1. A method for enhancing the deposit resistance of lubricating oil composition used under sustained high load conditions comprising adding to a Group II base stock oil a combination of additives comprising a minor amount of detergent comprising: i) a low TBN calcium alkyl salicylate a low TBN calcium phenate or combinations thereof at from 2.2 to 6.3 vol. % and optional overbased calcium phenate at from 0.3 to 0.5 vol. %, ii) at least two of the three of a phenolic antioxidant, a functionalized glycerine derivative with a grafted hindered phenolic moiety and a hindered phenolic containing a thioether group, wherein the phenolic antioxidant is at from about 0.75 to 2.0 vol. %, the functionalized glycerine derivative with a grafted hindered phenolic moiety is at from 0.50 to 3.0 vol. % and the hinder phenolic containing a thioether group is at from about 0.5 to 3 mass % active ingredient based on the weight of the lubricating oil composition, and iii) an organomolybdenum complex comprising molybdenum dithiocarbamate present in an amount sufficient to provide about 25 wppm to about 2000 wppm elemental molybdenum.

2. The method of claim 1 wherein the base stock oil has a kinematic viscosity at 100° C. of about 5 to about 20 $mm^2s$.

3. The method of claim 1 wherein the base stock oil has a kinematic viscosity at 100° C. of about 5 to about 16 $mm^2s$.

4. The method of claim 1 wherein the base stock oil has a kinematic viscosity at 100° C. of about 9 to about 13 $mm^2s$.

5. The method of claim 1, 2, 3 or 4 wherein the low TBN calcium alkyl salicylate and low TBN calcium phenate detergent has a TBN of about 114 mg KOH/g or less and the optional overbased calcium phenate detergent has a TBN of about 250 mg KOH/g or more.

6. The method of claim 1 wherein the organo molybdenum complex is present in an amount sufficient to provide about 50 wppm to about 500 wppm elemental molybdenum.

7. The method of claim 1, 2, 3 or 4 wherein the lubricating oil composition further includes about 0.5 vol. % of neutral calcium sulphonate detergent.

8. The method of claim 1, 2, 3 or 4 wherein the lubricating oil composition additionally contains one or more other additives comprising antioxidants, viscosity index improvers, pour point depressants, antiwear/extreme pressure additives, antifoamants, dyes, metal deactivators, additional detergents, dispersants.

9. The method of claim 1, 2, 3 or 4 wherein the lubricating oil composition is a stationary gas engine oil, stationary diesel engine oil, locomotive diesel engine oil, marine diesel engine oil.

10. The method of claim 8 wherein the one or more other additives are ashless additives.

* * * * *